US006808434B1

(12) United States Patent
Park

(10) Patent No.: US 6,808,434 B1
(45) Date of Patent: Oct. 26, 2004

(54) BUOYANT CHAIR AND TABLE ENSEMBLE

(76) Inventor: Gary T. Park, 1015 Quail Park Dr., Austin, TX (US) 78758

( * ) Notice: Subject to any disclaimer, the term of this patent is extended or adjusted under 35 U.S.C. 154(b) by 0 days.

(21) Appl. No.: 10/656,942

(22) Filed: Sep. 8, 2003

(51) Int. Cl.[7] ..... B63C 9/08
(52) U.S. Cl. ..... 441/130; 4/496
(58) Field of Search ..... 441/35, 129, 130; 4/496; 297/157.1, 170

(56) References Cited

U.S. PATENT DOCUMENTS 3,694,837 A 10/1972 Von Norring ..... 9/311
4,358,866 A * 11/1982 Rhodes ..... 441/35
4,724,773 A 2/1988 Newberry et al. ..... 108/150
5,465,677 A 11/1995 Alter ..... 114/230
5,518,431 A * 5/1996 Staley ..... 441/130
5,823,121 A 10/1998 Reiter ..... 108/147.19
6,171,160 B1 1/2001 Skaggs et al. ..... 441/129
6,209,147 B1 * 4/2001 Wheaton ..... 4/496
6,571,403 B2 * 6/2003 Wheaton ..... 4/496

* cited by examiner

*Primary Examiner*—S. Joseph Morano
*Assistant Examiner*—Lars A. Olson
(74) *Attorney, Agent, or Firm*—Christopher J. Whewell

(57) ABSTRACT

Provided herein is a buoyant ensemble comprising a plurality of chairs having a table centrally located among the chairs. An ensemble according to the invention is especially well-suited to be placed into a recreational body of water, such as a lake or swimming pool, to provide a location at which a small group of people may congregate to relax or take advantage of having a tabletop present in the water around which they may sit and relax or play board games such as chess, checkers, backgammon, dominoes, etc.

25 Claims, 9 Drawing Sheets

BUOYANT CHAIR AND TABLE ENSEMBLE

TECHNICAL FIELD

The present invention relates generally to floating devices, and more particularly to an ensemble of singular construction comprising a table and a plurality of seating means attached thereto that is sufficiently buoyant to float when disposed in a body of water.

BACKGROUND

Swimming pools and other bodies of water have been used for recreational purposes since the earliest of times. In order to enhance the bathing experience, various and sundry water toys such as floating basketball hoops, balls and other items have been devised.

One class of recreational item commonly used in association with swimming pools is a floating chair and floating rafts. Typically, such devices accommodate a single user, who sits in the chair or raft and relaxes, usually in the sun, while in contact with the water in the pool to take advantage of its cooling effect for providing refreshment. Often, such devices include accessory features such as cup holders, so that a person residing within such a floating chair may enjoy their favorite beverage in order to enhance the pleasure of the experience.

Some have found a floating but stable table structure, such as a table to be a desirable item for use in a swimming pool. The device described in U.S. Pat. No. 6,171,160 provides a table of sufficient sturdiness such that even when floating it will support a drink without spillage, owing to its primary feature of a stabilizing weight which is suspended beneath the table when in use.

Another device useful in enhancing the experience of bathing is described in U.S. Pat. No. 19,593 which teaches a plurality of life-preserving mattress tied together by belt-and-buckle strapping to form a raft. U.S. Pat. No. 4,894,033 teaches a structure including several inflatable rafts connected together by "T" and ring or loop interconnector devices. A floating chair made up of individual rigid sections but having flexible straps permanently interconnecting the sections is provided by U.S. Pat. No. 5,176,554. U.S. Pat. No. 5,411,425 teaches a floating structure having utility as a watercraft float which includes a pair of floating pillows interconnected by a seat, with connections being made only at the four corners of the pillows and seat. U.S. Pat. No. 3,694,837 teaches a floating body for bathing purposes that comprises a hollow cylindrical body having a partition wall that divides the interior of the body into an outer annular section and an inner central section. The inner central section has in its lower portion at least one opening through which water may enter into the section and that the upper portion of the inner central section has an opening to the atmosphere and a manually operable control valve for controlling the inner central section upper opening in order to vary the draught of the floating body. U.S. Pat. No. 4,724,773 provides a pedestal table in which the pedestal is to be releasably secured to the floor area of a smooth-surfaced hot tub, spa or pool, with the central support shaft of the table extending vertically through the water to the hot tub, spa or pool to support a table above the surface of the water. The pedestal table comprises: a) a generally cylindrical collar having a first and second ends, with at least the second end having an open passage therethrough; b) a peripheral flange extending from the collar adjacent to the first end of the collar; c) at least three elastomeric suction cups attached to the peripheral flange such that the suction cups are equally spaced about the peripheral flange and extend from the side of the flange facing away from the cylindrical collar, wherein the suction cups can be engaged with the floor area of the hot tub, spa or pool to releasably secure the collar to the floor area; d) an elongate, cylindrical column having sufficient length to extend from the floor area to the surface of the water, wherein the column has first and second ends, with the first end being received in sliding, the removable engagement within the second open end of the collar such that the column extends vertically upward from the collar; e) a cover for the cylindrical collar, wherein the cover has the shape of a truncated cone in which the cone covers the peripheral flange, the suction cups and the cylindrical collar, with the column extending through the truncated top of the cover; f) a planar tabletop member, and g) a means for attaching the planar top member to the second end of the column. U.S. Pat. No. 5,465,677 provides a float post apparatus comprising an elongated post having first and second opposite ends, a tether having first and second ends, tether mounting means attached to the post adjacent the second end, the first end of the tether having attachment means to attach the tether to the tether mounting means and the second end of the tether having attachment means to attach the tether to a person, the first end of the post adapted to be anchored at the bottom of a body of water, a mounting stand having a post receiving seat adapted to receive the first end of the float post, the mounting stand having a neck portion and having the post receiving seat formed in the neck portion, an aperture formed through the neck portion and a corresponding aperture formed through the post adjacent the first end of the post and being in alignment with the aperture in the neck when the post is received in the post receiving seat, and a locking member received in the apertures to lock the post to the mounting stand and a storage locker mounted on the second end of the post. U.S. Pat. No. 5,823,121 discloses a self-adjusting portable table for use in a spa having a floor and being filled with water to create a water surface, the self-adjusting portable table comprising: a) a base member, wherein the base member is adapted for positioning on the floor of the spa; b) a planar table top member having a substantially planar top surface, wherein the table top member is adapted to float on the water surface of the spa; and c) a self-adjusting vertical support member interconnecting the base member and the planar table top member, wherein the self-adjusting vertical support member is adapted for supporting the planar table top member in a generally horizontal position on the water surface of the spa; wherein the self-adjusting vertical support member comprises: an engaging member, wherein the engaging member is removably coupled to the base member, and a sleeve member, wherein the sleeve member is secured to the planar table top member, wherein the engaging member and the sleeve member are slidably telescopically coupled together such that the sleeve member slides freely over the engaging member, whereby the planar table top member is vertically self-adjustable towards and away from the base member corresponding to changes in a distance between the floor of the spa and the water surface of the spa U.S. Pat. No. 6,171,160 teaches a floating devices connection and/or storage system, comprising: a) a floating device having a peripheral edge; b) a predetermined number of connection devices arrayed about the floating device peripheral edge, each the connection device being hermaphroditic in construction; c) a means for assuring secure interconnection of a selected connection device with another, similar connection device; and d) a means for storing the floating device, comprising a plurality of suspension means on a vertical surface interconnected with the connection devices, and spacing means for separating the floating device from the vertical surface, thus assuring air flow about substantially the entire floating device and thus reducing the possibility of mildew and/or mold formation on the floating device during storage.

However, of all of the devices of the prior art, none thus far have provided a device which comprises a floating table around which two or more persons may sit while bathing in a body of water such as a swimming pool. Further, none have provided a floating table having a plurality of seating means associated with it, which are an integral part of the construct of such a floating table. Further, none have provided a floating table having a plurality of seating means as part of a unitary construction which is further provided with means for providing equalizing balancing means to provide a level tabletop surface even in cases where persons of significantly different weight are seated about such a table. The present invention provides such a table having a plurality of seating means disposed about it in a single unitary construction having ballasting means for compensating for the differences in weight of persons disposed about such a floating table, in addition to other advantageous features which will be recognized from a thorough reading of this specification and its appended claims.

SUMMARY OF THE INVENTION

The present invention provides an ensemble comprising a table and a plurality of seating means connectively attached thereto that is sufficiently buoyant as a whole to float when disposed in a body of water. An ensemble according to one form of the invention comprises a substantially planar framework which itself includes: a first linear frame member having a first end portion and a second end portion and having a hollow interior portion; a second linear frame member having a first end portion and a second end portion and having a hollow interior portion; a third linear frame member having a first end portion and a second end portion and having a hollow interior portion; and a fourth linear frame member having a first end portion and a second end portion and having a hollow interior portion. The first end portion of each of the first, second, third, and fourth linear frame members are connected to one another such that the hollow interior portions of each of the frame members are in fluid contact with one another. Each of the first, second, third, and fourth linear frame members are radially disposed about a common centerpoint. There is a first hollow structural conduit having a hollow interior portion, a first end portion, and a second end portion. The first end portion of the first hollow structural conduit is connected to the first linear frame member at a point between the first end portion and the second end portion of the first linear frame member. The second end portion of the first hollow structural conduit is connected to the second linear frame member at a point between the first end portion and the second end portion of the second linear frame member. There is a second hollow structural conduit having a hollow interior portion, a first end portion, and a second end portion, and the first end portion of the second hollow structural conduit is connected to the second linear frame member at a point between the first end portion and the second end portion of the second linear frame member. The second end portion of the second hollow structural conduit is connected to the third linear frame member at a point between the first end portion and the second end portion of the third linear frame member. There is a third hollow structural conduit having a hollow interior portion, a first end portion, and a second end portion. The first end portion of the third hollow structural conduit is connected to the third linear frame member at a point between the first end portion and the second end portion of the third linear frame member. The second end portion of the third hollow structural conduit is connected to the fourth linear frame member at a point between the first end portion and the second end portion of the fourth linear frame member. There is a fourth hollow structural conduit having a hollow interior portion, a first end portion, and a second end portion. The first end portion of the fourth hollow structural conduit is connected to the fourth linear frame member at a point between the first end portion and the second end portion of the fourth linear frame member. The second end portion of the fourth hollow structural conduit is connected to the first linear frame member at a point between the first end portion and the second end portion of the first linear frame member. The hollow interior portion of each of the hollow structural conduits are in fluid contact with the hollow interior portions of the linear frame members. The framework includes an opening between the space enclosed by the interior portions of the hollow structural conduits and the linear frame members and the space external to the interior portions of the hollow structural conduits and the linear frame members sufficient to admit water when the framework is submerged in a body of water. The second end portion of each of the first, second, third, and fourth linear frame members are curved upwardly from the plane of the planar framework. There is a seating means disposed at the second end portion of each of the first, second, third, and fourth linear frame members. There is a vertical support beam having a first end portion and a second end portion. The first end of the vertical support beam is connected to the planar framework at the common centerpoint about which the first, second, third, and fourth linear frame members are radially disposed. There is a buoyant tabletop having a planar top surface disposed at the second end portion of the vertical support beam.

In a more general sense, the invention comprises a substantially planar framework comprising hollow structural members each having an interior volume, wherein the interior volume at least two of the structural members of the framework are in fluid contact with one another. The framework includes an opening to render the interior volume to be in fluid contact with the external surroundings, such that water is admitted into the interior volume upon submersion of the framework into a body of water. There is a buoyant tabletop portion centrally disposed above the plane of the planar framework, and a plurality of seating means connected to the framework. The seating means are disposed so that the tabletop portion is centrally located with respect to the seating means.

DETAILED DESCRIPTION

Figure 1:
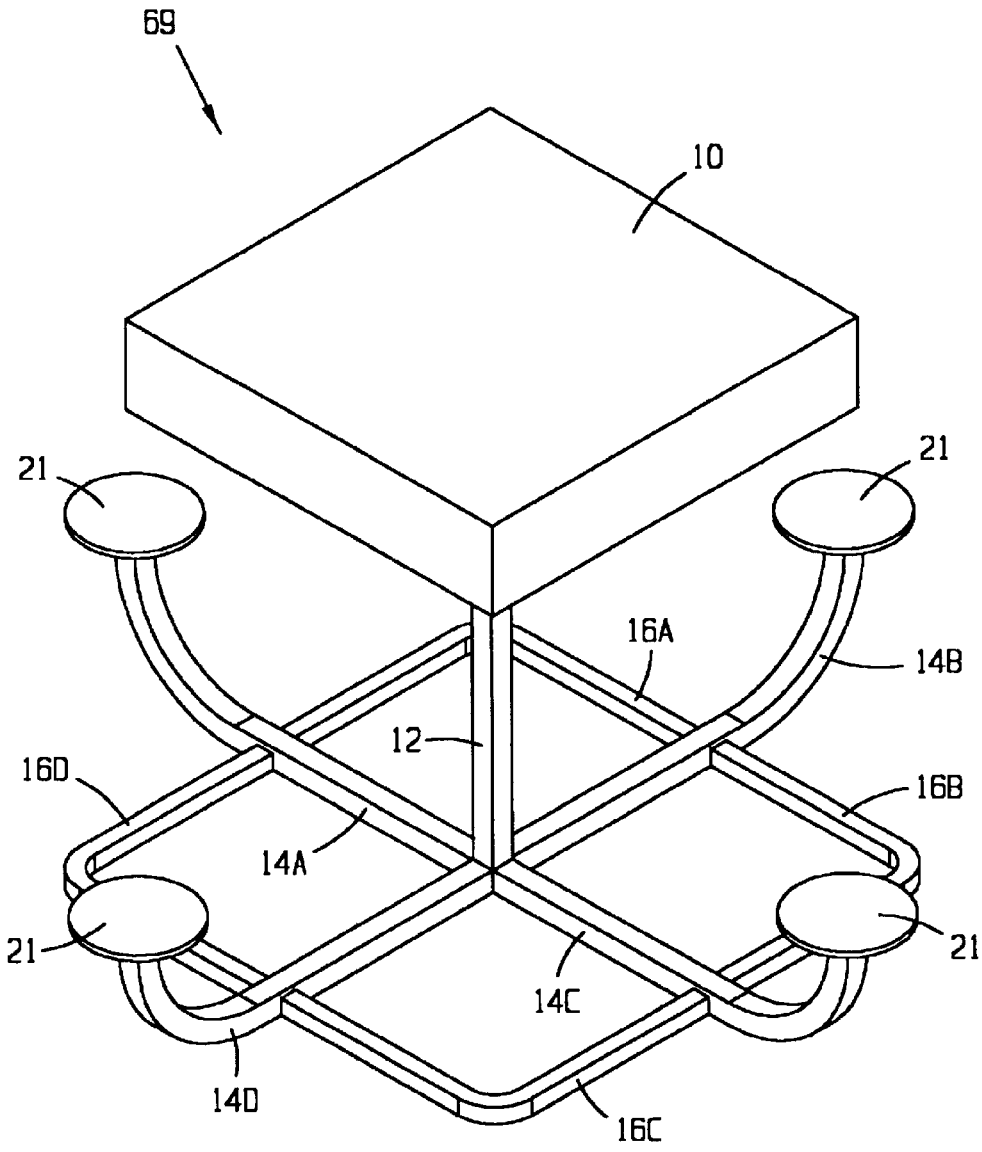
FIG. 1 is a perspective view of a floating table and seat ensemble according to one preferred form of the invention.

Referring to the drawings and initially to FIG. 1 there is shown a perspective view of a floating table and seat ensemble 69 according to one preferred form of the invention. In this FIG. 1 are shown the first linear frame member 14*a*, second linear frame member 14*b*, third linear frame member 14*c*, and fourth linear frame member 14*d* arranged wherein the first end portion of each of the aforesaid linear frame members are connected to one another at a common center point of intersection from which each of the linear frame members may be said to be disposed about radially.

There is also shown in FIG. 1 the first hollow structural conduit 16*a*, second hollow structural conduit 16*b*, third hollow structural conduit 16*c*, and fourth hollow structural conduit 16*d*.

In this FIG. 1, the first hollow structural conduit 16*a* has its first end portion connected to the first linear frame member 14*a* at a point between the first end portion and the second end portion of the first linear frame member 14*a*, and the second end portion of the first hollow structural conduit 16*a* is connected to the second linear frame member 14*b* at a point between the first end portion and the second end portion of the second linear frame member 14*b*. Additionally, the second hollow structural conduit 16*b* has its first end portion connected to the second linear frame member 14*b* at a point between the first end portion and the second end portion of the second linear frame member 14*b*, and the second end portion of the second hollow structural conduit 16*b* is connected to the third linear frame member 14*c* at a point between the first end portion and the second end portion of the third linear frame member 14*c*. The third hollow structural conduit 16*c* has its first end portion connected to the third linear frame member 14*c* at a point between the first end portion and the second end portion of the second linear frame member 14*c*, and the second end portion of the third hollow structural conduit 16*c* is connected to the fourth linear frame member 14*d* at a point between the first end portion and the second end portion of the fourth linear frame member 14*d*. The fourth hollow structural conduit 16*d* has its first end portion connected to the fourth linear frame member 14*d* at a point between the first end portion and the second end portion of the fourth linear frame member 14*d*, and the second end portion of the fourth hollow structural conduit 16*d* is connected to the first linear frame member 14*a* at a point between the first end portion and the second end portion of the first linear frame member 14*a*.

FIG. 1 also shows the vertical support beam 12 with its first end portion attached to the center of the planar framework defined by the plurality of hollow structural conduits and linear frame members, extending upwardly from the plane of the planar framework, and having a the buoyant tabletop 10 with its planar top surface disposed on the second end portion of the vertical support beam 12.

There are a plurality of seating means 21 disposed at the second end portion of each of the first, second, third, and fourth linear frame members. From FIG. 1, it is apparent according to one preferred form of the invention that the second end portion of each of the linear frame members are curved upwardly from the plane of the planar framework which is comprised of the linear frame members and the hollow structural conduits, and that it is at the curved end at which the seating means are connectively attached. Such seating means provides a location for people to sit while using and enjoying the benefits of an ensemble 69 according to the invention.

Figure 2:
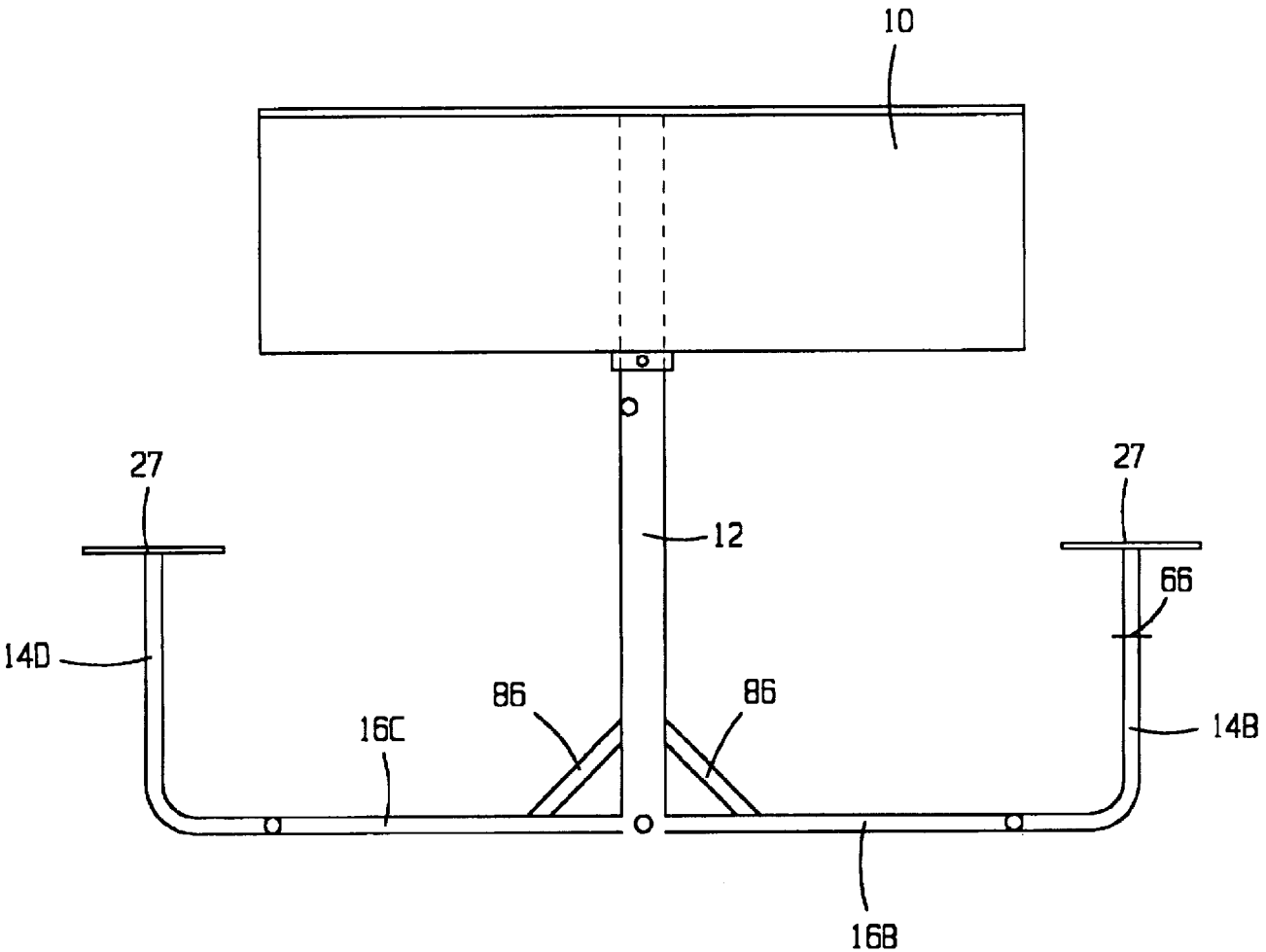
FIG. 2 is a side perspective view of a floating table and seat ensemble according to one preferred form of the invention.

FIG. 2 shows a side perspective view of a floating table and seat ensemble 69 according to one preferred form of the invention, showing the respective positions of the second linear frame member 14*b*, fourth linear frame member 14*d*, second hollow structural conduit 16*b*, and third hollow structural conduit 16*c*. Disposed on the ends of the linear frame members which curve upwardly from the plane of the framework comprised of the linear frame members and the hollow structural conduits are flanges at 27 which in one form of the invention serve as a convenient connection means for the seating means 21. The flange at 27 may be simply a plate of metal attached to the second end portion of the linear frame member, to which a seating means may be conveniently attached to the ensemble 69 as a whole using conventional fastening means, as the attachment of seating means to metal plates is well known in the art. The seating means 21 may be a flat piece of wood, metal, or plastic, or may comprise a cushioned seat, filled with foam or other soft materials, as are known in the art. The size of the seating means is not critical, and the main requirement is that it should be of sufficient area to accommodate the seating size requirements of most people. There is also shown the vertical support 12 having its first end portion connected to the planar framework at the common centerpoint about which the first, second, third, and fourth linear frame members are radially disposed. The vertical support 12 extends upwardly from the plane of the planar framework which is comprised of the linear frame members and the hollow structural conduits. There is a buoyant tabletop 10 having a planar top surface disposed at the second end portion of the vertical support beam. For added strength, braces 86 are connectively attached to the vertical support 12 and each of the hollow structural conduits.

Figure 3:
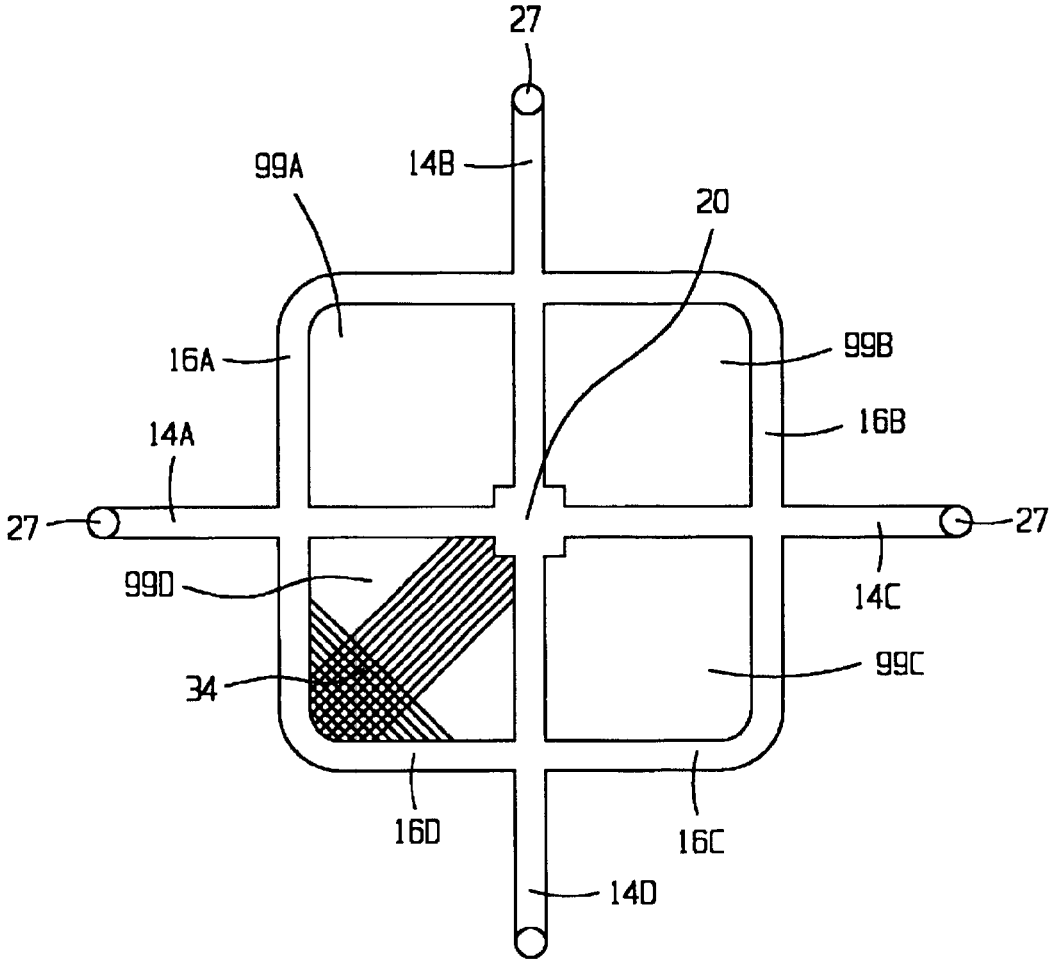
FIG. 3 is an overhead view of the framework portion of a table and seat ensemble according to one preferred form of the invention.

In FIG. 3 is shown an overhead view of the framework portion of a table and seat ensemble 69 according to one form of the invention. In this figure are shown the various linear frame members 14*a*, 14*b*, 14*c*, 14*d*, and the various hollow structural conduits 16*a*, 16*b*, 16*c*, and 16*d*, as well as the intersection point 20 of the first end portions of the linear frame members and the mounting points 27 for the flanges where the seating means are preferably mounted. The first hollow structural conduit 16*a* and the first and second linear frame members 14*a* and 14*b* define the outer perimeter of a first planar footspace, 99*a* within the same plane as the planar framework. Further, the second hollow structural conduit 16*b* and the second and third linear frame members 14*b* and 14*c* define the outer perimeter of a second planar footspace 99*b*. Further the third hollow structural conduit

16*c* and the third and fourth linear frame members 14*c* and 14*d* define the outer perimeter of a third planar footspace 99*c*. Further, the fourth hollow structural conduit 16*d* and the fourth and first linear frame members 14*d* and 14*a* define the outer perimeter of a fourth planar footspace 99*d*. These footspaces are the locations where a person sitting on the ensemble 69 of the invention may rest their feet, by virtue of each of the planar footspaces each including a floor portion means 34 connected to the hollow structural conduit and linear frame members which define the respective footspaces. According to one preferred form of the invention, the floor portion means is non-metallic. Preferably, the floor portion means is made from a woven polymer, such as woven nylon, PVC, or polyolefin and is attached to the framework by conventional means such as adhesives or being woven to tied to one or more holes in the framework elements.

Figure 4:
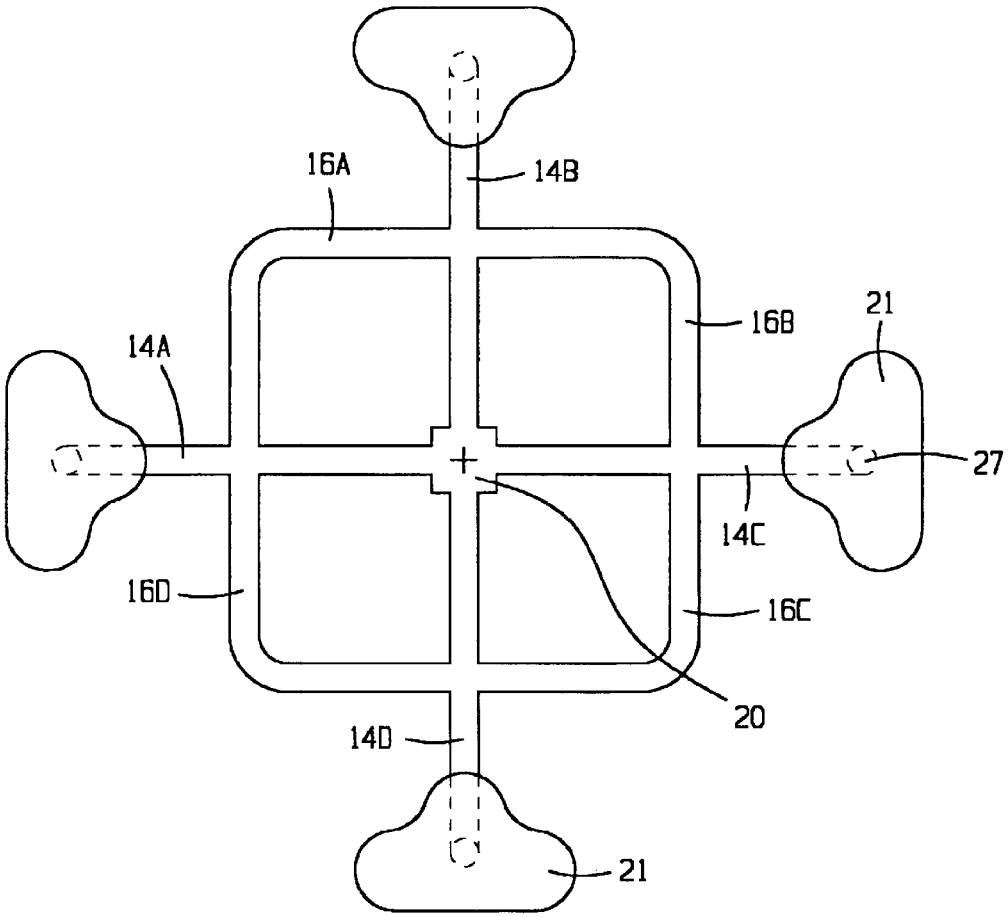
FIG. 4 is a is an overhead view of the framework portion of a table and seat ensemble according to one preferred form of the invention, including the seating means.

In FIG. 4 is shown a is an overhead view of the framework portion of a table and seat ensemble 69 according to one preferred form of the invention, including the seating means 21 mounted at 27. There is also shown the first, second, third, and fourth linear frame members 14*a*, 14*b*, 14*c*, 14*d*, with their first end portions intersecting at 20. Also shown are the first, second, third, and fourth hollow structural conduits 16*a*, 16*b*, 16*c*, and 16*d*.

Figure 5:
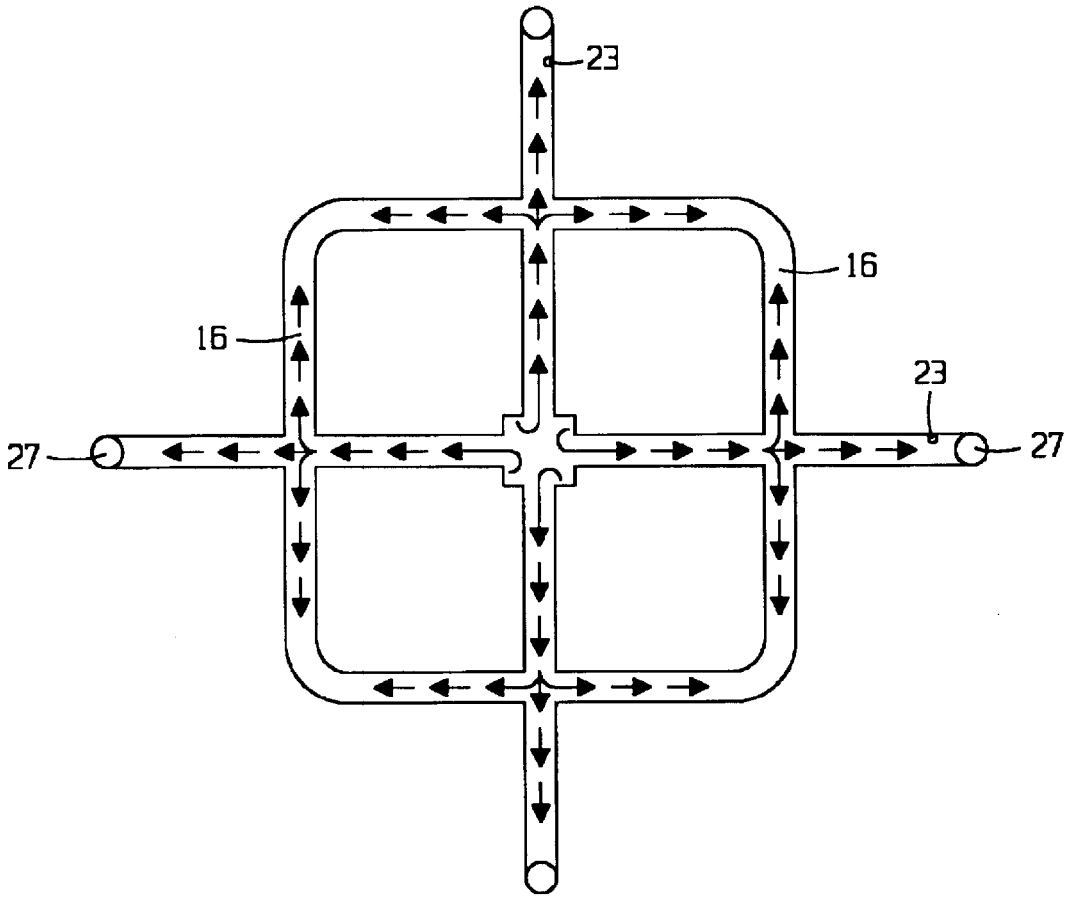
FIG. 5 is a see-through view of the framework portion of a table and seat ensemble according to one preferred form of the invention.

In FIG. 5 is shown a is a see-through overhead view of the framework portion of a table and seat ensemble 69 according to one preferred form of the invention, including the seating means 21 mounted at 27. There is also shown the first, second, third, and fourth linear frame members 14*a*, 14*b*, 14*c*, 14*d*, with their first end portions intersecting at 20. Also shown are the first, second, third, and fourth hollow structural conduits 16*a*, 16*b*, 16*c*, and 16*d*. In this figure, the arrows indicate the possible motion of water within the interior spaces of the linear frame members and hollow structural conduits, which water is admitted into such interior spaces by virtue of the presence of an opening between the space enclosed by the interior portions of the hollow structural conduits and the linear frame members, and the space external them. Preferably, the hole is disposed beneath the intersection point 20, at location shown as 25 in FIG. 6. According to one preferred form of the invention, there are openings 23 disposed at or near the seating means mounting point 27 of each of the linear frame members, to facilitate the entry of water into the cavernous interior spaces of the linear frame members and hollow structural conduits, for in the absence of such openings air would otherwise be entrained in the space where the second end portions of the linear frame members curve upwardly and would preclude the flow of water therein. By enabling admittance of water into the device as provided by such a construct, advantageous buoyancy of the ensemble 69 of the invention as a whole is provided.

Figure 6:
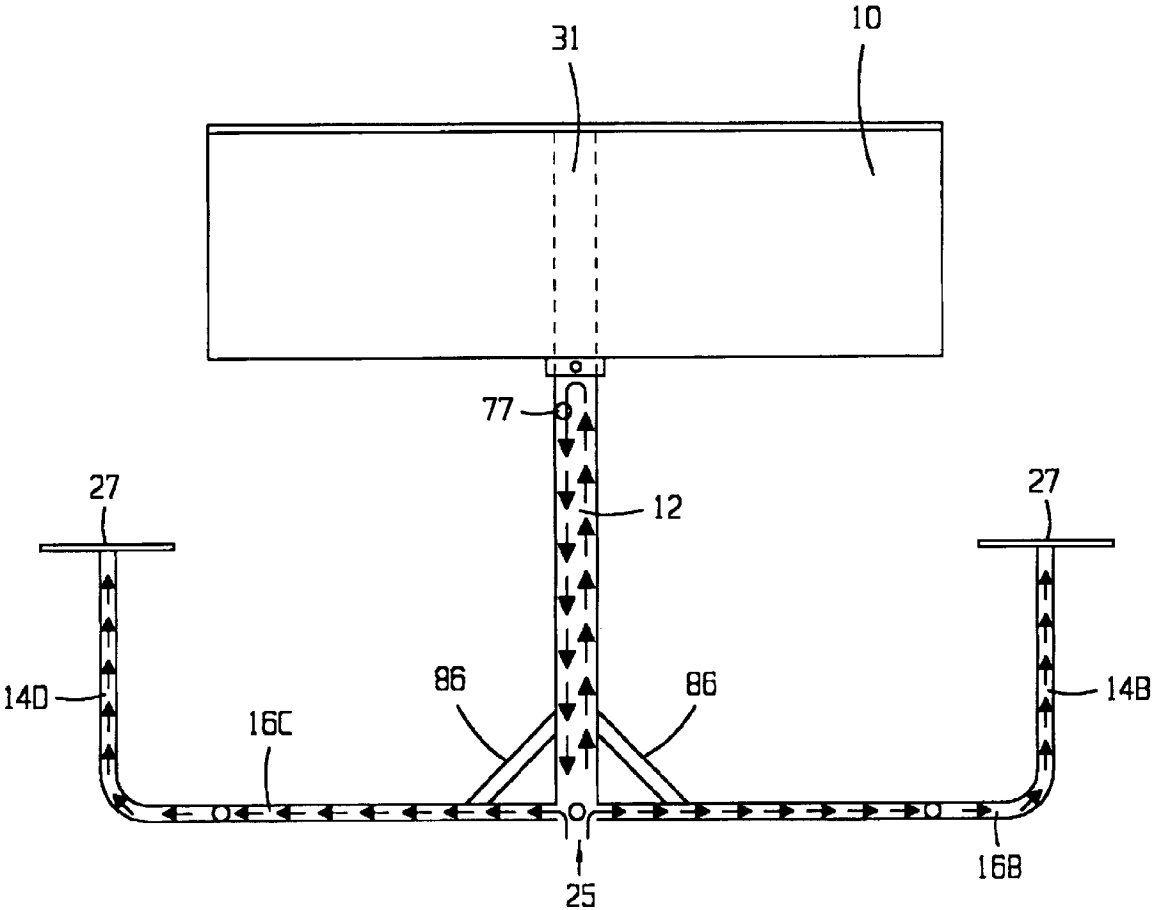
FIG. 6 is a side perspective view of a floating table and seat ensemble according to one preferred form of the invention.

FIG. 6 shows a see-through side perspective view of a floating table and seat ensemble 69 according to one preferred form of the invention, showing the respective positions of the second linear frame member 14*b*, fourth linear frame member 14*d*, second hollow structural conduit 16*b*, and third hollow structural conduit 16*c*. Disposed on the ends of the linear frame members which curve upwardly from the plane of the framework comprised of the linear frame members and the hollow structural conduits are flanges at 27 which in one form of the invention serve as a convenient connection means for the seating means 21. There is also shown the vertical support 12 having its first end portion connected to the planar framework at the common centerpoint about which the first, second, third, and fourth linear frame members are radially disposed. The vertical support 12 extends upwardly from the plane of the planar framework which is comprised of the linear frame members and the hollow structural conduits. There is a buoyant tabletop 10 having a planar top surface disposed at the second end portion of the vertical support beam. For added strength, braces 86 are connectively attached to the vertical support 12 and each of the hollow structural conduits. In FIG. 6 is also shown the flow of water through the various structural elements of the ensemble 69 including the linear frame members, the hollow structural conduits, and the vertical support 12. When an ensemble 69 according to the invention is placed in a body of water, water is admitted into the interior volume defined by these structural elements through the hole at 25 which is located on the underside of the framework as a whole, at the intersection point 20 of the first end portions of the linear frame members. According to one form of the invention, the vertical support 12 has an opening at its second end. According to another form of the invention, the vertical support 12 includes a hole 77 disposed along its length, for the purpose of facilitating entry of water into the space within the vertical support 12. Also shown in FIG. 6 is the vertical support guide 31, which may be a bore, sleeve, or channel which is contoured identically to the second end portion of the vertical support 12, but is of a slightly larger inner dimension to accommodate the insertion of the second end portion of the vertical support 12 therein to provide an interference fit between the vertical support and the tabletop 10. In one form of the invention, the vertical support 12 is square in cross section, and the vertical support guide 31 is a square shaped tube of slightly larger dimension than the vertical support 12. In another form of the invention, the vertical support 12 is round in cross section, and the vertical support guide 31 is a round tube of slightly larger dimension than the vertical support 12. The vertical support guide may be an integral part of the tabletop portion 10, or it may be a separate article of manufacture attached to the tabletop portion by any conventional means, such as welding or conventional fasteners such as screws, nuts and bolts, or rivets, etc.

Figure 7A:
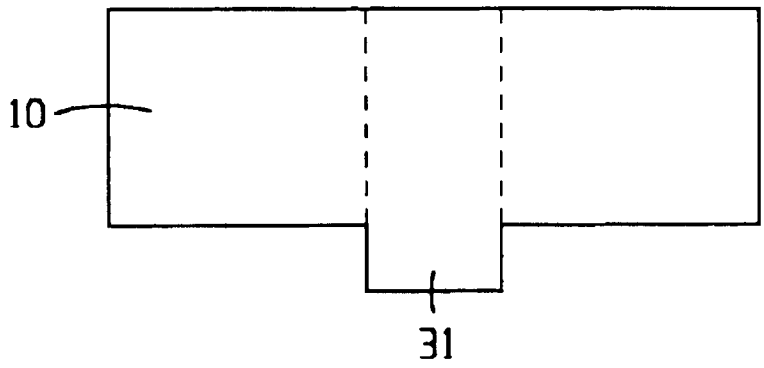
FIG. 7*a* is a side view of a buoyant tabletop portion of an ensemble according to one preferred form of the invention.

FIG. 7*a* shows a side view of a buoyant tabletop portion 10 of an ensemble 69 according to one preferred form of the invention. In this figure is seen the vertical support guide 31 centrally disposed within the tabletop portion.

Figure 7B:
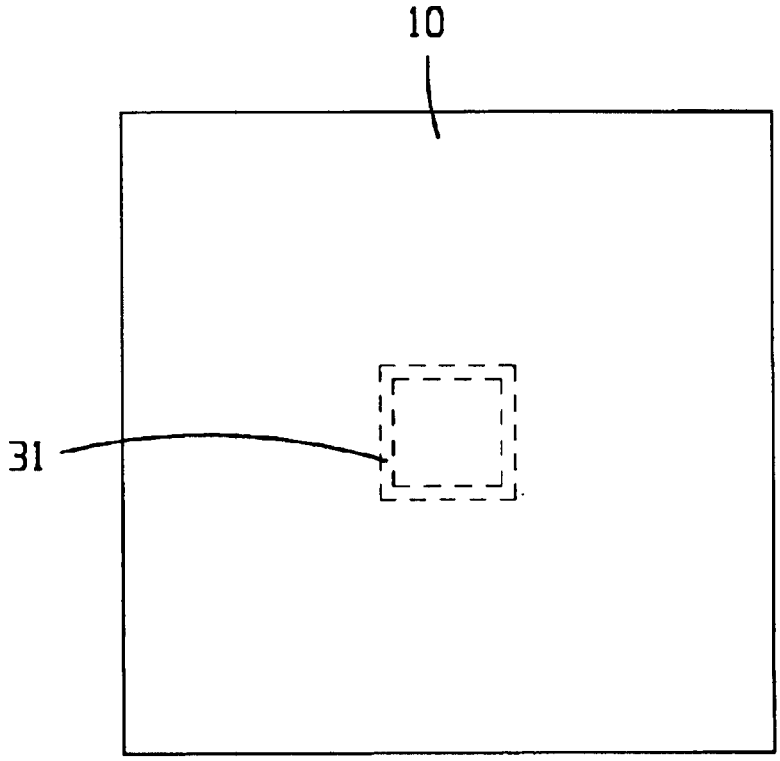
FIG. 7*b* is an overhead view of a buoyant tabletop portion of an ensemble according to one preferred form of the invention.

FIG. 7*b* shows an overhead view of a buoyant tabletop portion 10 of an ensemble 69 according to one preferred form of the invention. In this figure is seen the vertical support guide 31 centrally disposed within the tabletop portion.

Figure 8A:
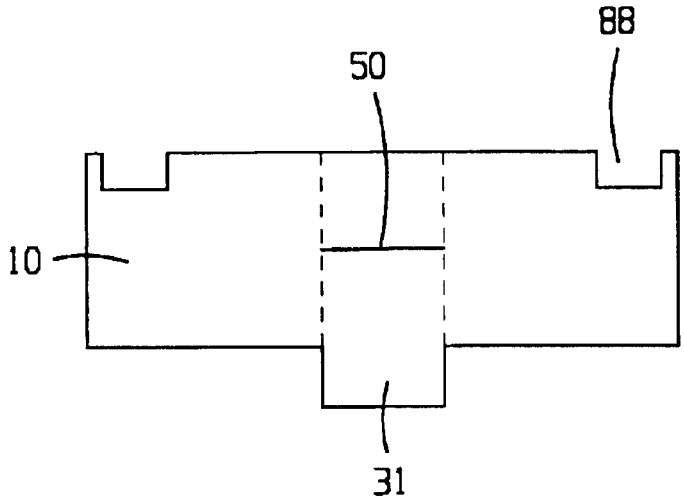
FIG. 8*a* is a side view of a buoyant tabletop portion of an ensemble according to one alternate form of the invention.

FIG. 8*a* shows a side view of a buoyant tabletop portion 10 of an ensemble 69 according to one preferred form of the invention. In this figure is seen the vertical support guide 31 centrally disposed within the tabletop portion. Also shown are cutout portions 88, useful for containing a beverage container such as a glass or soda pop can. Such cutout portions 88 are holes or voids.

Figure 8B:
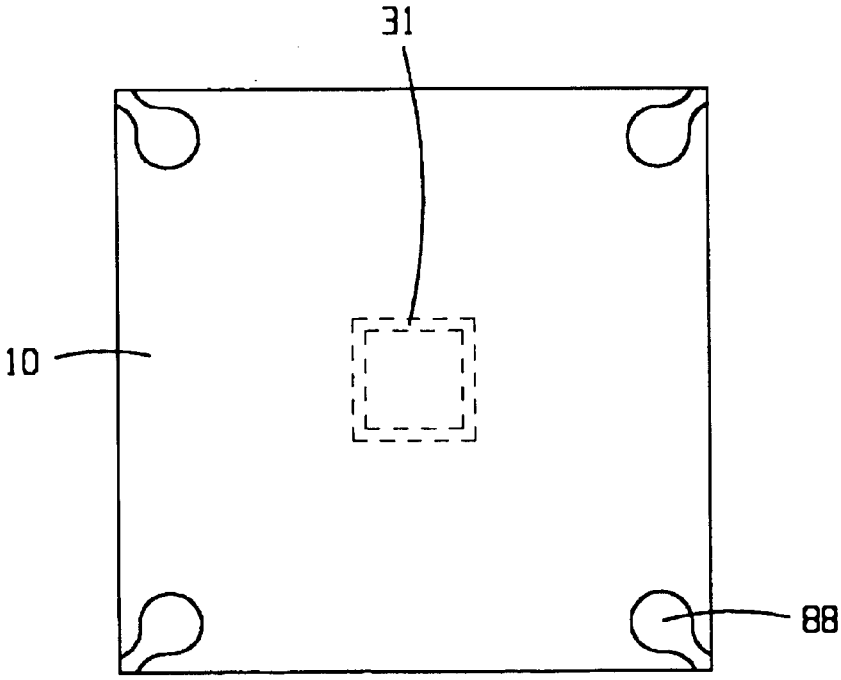
FIG. 8*b* is an overhead view of a buoyant tabletop portion of an ensemble according to one alternate form of the invention.

FIG. 8*b* shows an overhead view of a buoyant tabletop portion 10 of an ensemble 69 according to one preferred form of the invention. In this figure is seen the vertical support guide 31 centrally disposed within the tabletop portion. Also shown are cutout portions 88, useful for containing a beverage container such as a glass or soda pop can.

Figure 9:
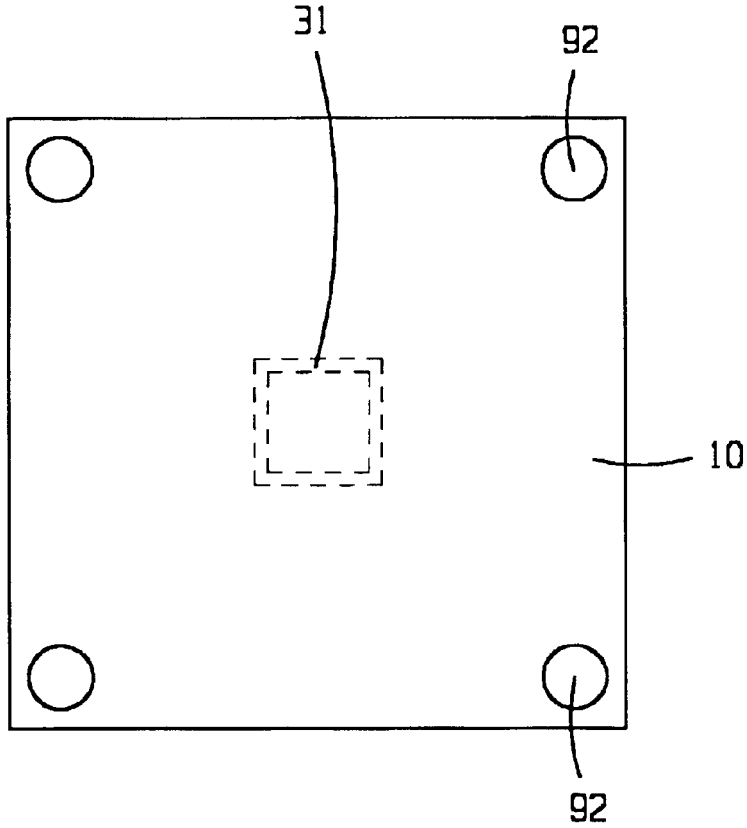
FIG. 9 is an overhead view of a buoyant tabletop portion of an ensemble according to one alternate form of the invention.

FIG. 9 shows an overhead view of a buoyant tabletop portion 10 of an ensemble 69 according to one preferred form of the invention. In this figure is seen the vertical support guide 31 centrally disposed within the tabletop portion. Also shown are cutout portions 88, useful for containing a beverage container such as a glass or soda pop can.

The main structural elements of the present invention include the linear frame members 14*a*, 14*b*, 14*c*, 14*d*, the hollow structural conduits 16*a*, 16*b*, 16*c*, 16*d*, and the vertical support 12. According to one preferred form of the invention, these elements each contain a hollow interior space. This is readily provided for by selecting the materials from which they are fabricated from a tubular stock. In the simplest case, the aforesaid structural elements are made from tubing, such as metal pipes, or PVC tubing. PVC plastic is particularly preferred because of its relatively low weight, inertness, and strength. However, metallic tubing may be selected as the material from which these structural elements are comprised, such as aluminum, galvanized steel, or stainless steel tubing. These structural elements are connected to one another using conventional means, such as by welding when they are comprised of a metallic material which can be welded. In the case when PVC or other polymeric material comprises the structural elements, means known in the art for joining polymeric materials are suitable for connecting the structural elements, including solvent welding, adhesives, etc. In addition, conventional fasteners such as adhesives, brackets, nuts and bolts, screws, rivets, etc. may be employed to fasten the various structural elements to one another to provide an ensemble 69 according to the invention. In one preferred form of the invention, the linear frame members and hollow structural conduits are made from square metallic tubing having a cross section measurement, and the ends of the hollow structural conduits are fitted over holes in the side walls of the linear frame members in a sealing fashion, such as by a weld bead around the perimeter of the joint. The holes in the side walls of the linear frame members are of a lesser dimension than the cross section measurement of the square metallic tubing employed. In addition, although the hollow structural elements in FIG. 1 et al. all collectively define a square by virtue of each of the hollow structural elements comprising a portion that has an angle of about 90° along their length between their first end portion and their second end portion, the present invention contemplates other shapes for these hollow structural elements, including the case where the hollow structural elements are arcuate in shape and thus collectively define a circle when viewed as a whole.

The tabletop portion 10 preferably comprises a hollow box that in one preferred form of the invention is shaped substantially in the form of a rectangular solid as shown in the various figures. The purpose of the tabletop portion 10 is to provide buoyancy to the ensemble 69 of the invention as a whole. The tabletop portion 10 provides buoyancy by virtue of its being filled with air, which provides a buoyancy effect by displacing water with the air contained within the tabletop portion 10 when the ensemble 69 of the invention is placed into a body of water. By allowing water to be admitted into the structural elements of the ensemble 69 and by having the buoyancy provided by the centrally-located tabletop, an especially stable structure is provided upon which people may sit and enjoy a truly unique recreational experience of sitting at a table in the water.

Thus, the tabletop portion excludes water from its interior in order to provide a buoyancy to the ensemble 69 as a whole. In one preferred form, the tabletop is comprised of a floor portion, four wall portions, and a flat top portion. In one preferred form of the invention, the floor portion is provided with a square hole in its center. A section of square tubing functions as vertical support guide 31 and is placed through the hole and welded or attached using conventional means described elsewhere herein, either on the inside, outside, or both surfaces where the square tubing meets the floor portion. In such fashion, the tabletop may be lowered onto the second end portion of the vertical support 12, for the case when the cross section of the vertical support 12 is square and of slightly smaller diameter than the vertical support guide 31. Analogous arrangements are functionally-equivalent possibilities for cases when the tubing is circular in cross section, or has other cross-sectional geometries. In addition, the vertical support guide 31 may include a stop (50 in FIG. 8*a*) to limit the travel of the vertical support 12 in the bore defined by the vertical support guide 31. According to one preferred form of the invention, the second end portion of the vertical support 12 is placed into the vertical support guide 31 and is welded in position. According to an alternate form of the invention, the second end portion of the vertical support 12 is placed into the vertical support guide 31 and is removably held in position by the use of conventional brackets and fasteners coupling the vertical support guide 31 to the vertical support 12. One convenient means includes the use of a lynch pin disposed through a bore which is common to both the vertical support 12 and the vertical support guide 31 and which bore is disposed perpendicular to the length dimension of the vertical support 12. By such provision, the tabletop portion is readily detachable from the remaining portions of the ensemble 69.

The tabletop portion 10 may also, in an alternate form of the invention, be filled with a foamed material, such as expanded polystyrene. In any event, the tabletop portion is sufficiently buoyant to provide a degree of buoyancy to the ensemble 69 as a whole to float while said ensemble is disposed in a body of water and a total human mass in the range of 200 to 1000 lbs is disposed on the plurality of seating means present. According to a preferred form of the invention, the tabletop portion measures 3 feet wide by 3 feet long by 2 feet high for a total displacement of about 18 cubic feet which provides a maximum buoyancy of about 1100 pounds, which is more than adequate to support the device and four adult people.

The invention includes means for attaching weights to the framework, in order to adjust the degree of levelness of the tabletop for the various possible cases of persons having different weights seated on an ensemble according to the invention. Such means may be simple hooks where weights may be attached at various locations on the framework or other parts of the present invention, or may be a protruding flange such as at 66 in FIG. 2 where a weight may be placed. The present invention also contemplates the use of air entrained within a plastic or other membrane or enclosure, to be used to level the table top by affixing such contained air to any desired location of the framework or other elements of the invention.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. An ensemble comprising a table and a plurality of seating means connectively attached thereto that is sufficiently buoyant as a whole to float when disposed in a body of water which comprises:

I) a substantially planar framework which comprises a) a first linear frame member having a first end portion and a second end portion and having a hollow interior portion b) a second linear frame member having a first end portion and a second end portion and having a hollow interior portion c) a third linear frame member having a first end portion and a second end portion and having a hollow interior portion d) a fourth linear frame member having a first end portion and a second end portion and having a hollow interior portion;

wherein the first end portion of each of said first, second, third, and fourth linear frame members are connected to one another such that the hollow interior portions of each of said frame members are in fluid contact with one another; and wherein each of said first, second, third, and fourth linear frame members are radially disposed about a common centerpoint;

e) a first hollow structural conduit having a hollow interior portion, a first end portion, and a second end portion, wherein said first end portion of said first hollow structural conduit is connected to said first linear frame member at a point between said first end portion and said second end portion of said first linear frame member, and wherein said second end portion of said first hollow structural conduit is connected to said second linear frame member at a point between said first end portion and said second end portion of said second linear frame member;

f) a second hollow structural conduit having a hollow interior portion, a first end portion, and a second end portion, wherein said first end portion of said second hollow structural conduit is connected to said second linear frame member at a point between said first end portion and said second end portion of said second linear frame member, and wherein said second end portion of said second hollow structural conduit is connected to said third linear frame member at a point between said first end portion and said second end portion of said third linear frame member;

g) a third hollow structural conduit having a hollow interior portion, a first end portion, and a second end portion, wherein said first end portion of said third hollow structural conduit is connected to said third linear frame member at a point between said first end portion and said second end portion of said third linear frame member, and wherein said second end portion of said third hollow structural conduit is connected to said fourth linear frame member at a point between said first end portion and said second end portion of said fourth linear frame member;

h) a fourth hollow structural conduit having a hollow interior portion, a first end portion, and a second end portion, wherein said first end portion of said fourth hollow structural conduit is connected to said fourth linear frame member at a point between said first end portion and said second end portion of said fourth linear frame member, and wherein said second end portion of said fourth hollow structural conduit is connected to said first linear frame member at a point between said first end portion and said second end portion of said first linear frame member;

wherein the hollow interior portion of each of said hollow structural conduits are in fluid contact with the hollow interior portions of said linear frame members wherein said framework includes an opening between the space enclosed by said interior portions of said hollow structural conduits and said linear frame members and the space external to said interior portions of said hollow structural conduits and said linear frame members sufficient to admit water when said framework is submerged in a body of water;

wherein the second end portion of each of said first, second, third, and fourth linear frame members are curved upwardly from the plane of said planar framework;

II) a seating means disposed at the second end portion of each of said first, second, third, and fourth linear frame members;

III) a vertical support beam having a first end portion and a second end portion, said first end of said vertical support beam being connected to said planar framework at the common centerpoint about which said first, second, third, and fourth linear frame members are radially disposed; and IV) a buoyant tabletop having a planar top surface disposed at said second end portion of said vertical support beam.

2. An ensemble according to claim 1 wherein the angle of the intersection of any two adjacent first, second, third, or fourth linear frame members which are radially disposed about said common centerpoint is about 90 degrees.

3. An ensemble according to claim 1 wherein said buoyant tabletop is shaped substantially in the form of a rectangular solid.

4. An ensemble according to claim 3 wherein said buoyant tabletop comprises a hollow interior volume which is isolated from its surroundings.

5. An ensemble according to claim 4 wherein said interior volume of said buoyant tabletop comprises air.

6. An ensemble according to claim 4 wherein said interior volume of said buoyant tabletop comprises a foamed polymer.

7. An ensemble according to claim 4 wherein said interior volume of said buoyant tabletop comprises expanded polystyrene.

8. An ensemble according to claim 1 wherein said opening is disposed beneath the common centerpoint about which said first, second, third, and fourth linear frame members are radially disposed.

9. An ensemble according to claim 1 wherein said first, second, third, and fourth linear frame members include a means for mounting a counterweight.

10. An ensemble according to claim 1 wherein the second end portion of said first, second, third, and fourth linear frame members includes an opening to the external surroundings of the space enclosed by said first, second, third, and fourth linear frame members.

11. An ensemble according to claim 1 wherein said tabletop portion includes at least one cutout portion adapted to receive a beverage container.

12. An ensemble according to claim 1 wherein said first hollow structural conduit and said first and second linear frame members define the outer perimeter of a first planar footspace, and wherein said second hollow structural conduit and said second and third linear frame members define the outer perimeter of a second planar footspace, and wherein said third hollow structural conduit and said third and fourth linear frame members define the outer perimeter of a third planar footspace, and wherein said fourth hollow structural conduit and said fourth and first linear frame members define the outer perimeter of a fourth planar footspace, wherein said planar footspaces each include a floor portion means connected to the hollow structural conduit and linear frame members which define the respective footspaces.

13. An ensemble according to claim 12 wherein said floor portion means comprises a woven material.

14. An ensemble according to claim 12 wherein said woven material is non-metallic.

15. An ensemble according to claim 12 wherein said woven material comprises a vinyl mesh.

16. An ensemble according to claim 1 wherein said ensemble as a whole is sufficiently buoyant to float while said ensemble is disposed in a body of water and four men, each weighing between 100 and 250 pounds, are seated, one on each of said seating means.

17. An ensemble according to claim 16 and further comprising at least one weight attached to said framework.

18. An ensemble comprising a table and a plurality of seating means connectively attached thereto that is sufficiently buoyant as a whole to float when disposed in a body of water which comprises:

a) a substantially planar framework comprising hollow structural members each having an interior volume, wherein the interior volume at least two of said structural members of said framework are in fluid contact with one another and wherein said framework includes an opening to render said interior volume to be in fluid contact with the external surroundings such that water is admitted into said interior volume upon submersion of said framework into a body of water;

b) a vertical support beam having a first end portion and a second end portion, wherein said first end portion of said vertical support beam is connected to said framework such that it extends upwardly from the plane of said planar framework;

c) a buoyant tabletop portion centrally disposed above the plane of said planar framework and connected to said second end portion of said vertical support beam;

d) a plurality of seating means connected to said framework, wherein said seating means are disposed so that the tabletop portion is centrally located with respect to said seating means.

19. An ensemble according to claim 18 wherein said ensemble as a whole is sufficiently buoyant to float while said ensemble is disposed in a body of water and a total human mass in the range of 200 to 1000 lbs is disposed on said plurality of seating means.

20. An ensemble according to claim 18 wherein said buoyant tabletop comprises a hollow interior volume which is isolated from its surroundings.

21. An ensemble according to claim 20 wherein said interior volume of said buoyant tabletop comprises air.

22. An ensemble according to claim 20 wherein said interior volume of said buoyant tabletop comprises a foamed polymer.

23. An ensemble according to claim 20 wherein said interior volume of said buoyant tabletop comprises expanded polystyrene.

24. An ensemble according to claim 18 wherein said vertical support beam includes a hollow interior portion which as adapted to receive water upon immersion of said ensemble into a body of water.

25. An ensemble according to claim 18 wherein the buoyancy for said ensemble is provided solely by said tabletop portion.

* * * * *